US008552400B2

(12) United States Patent
Naka et al.

(10) Patent No.: US 8,552,400 B2
(45) Date of Patent: Oct. 8, 2013

(54) ELECTRON BEAM STERILIZER FOR CAP

(71) Applicant: Shibuya Kogyo Co., Ltd., Ishikawa (JP)

(72) Inventors: Toshiaki Naka, Ishikawa (JP); Yukinobu Nishino, Ishikawa (JP); Tokuo Nishi, Ishikawa (JP); Ryoji Koudo, Ishikawa (JP); Satoshi Masumoto, Ishikawa (JP); Soma Watanabe, Ishikawa (JP); Yusuke Hirosawa, Ishikawa (JP); Mitsuhiro Fujita, Ishikawa (JP)

(73) Assignee: Shibuya Kogyo Co., Ltd., Ishikawa (JP)

( * ) Notice: Subject to any disclaimer, the term of this patent is extended or adjusted under 35 U.S.C. 154(b) by 0 days.

(21) Appl. No.: 13/726,887

(22) Filed: Dec. 26, 2012

(65) Prior Publication Data

US 2013/0161532 A1 Jun. 27, 2013

(30) Foreign Application Priority Data

Dec. 27, 2011 (JP) ..... 2011-285754

(51) Int. Cl.
*B65B 55/08* (2006.01)

(52) U.S. Cl.
CPC ..... *B65B 55/08* (2013.01)
USPC ..... 250/455.11; 250/453.11

(58) Field of Classification Search
USPC ..... 250/455.11, 453.11, 434; 422/22, 24, 422/186.3
See application file for complete search history.

(56) References Cited

U.S. PATENT DOCUMENTS

| | | | | |
|---|---|---|---|---|
| 7,739,859 | B2 * | 6/2010 | Colato et al. | 53/426 |
| 7,767,987 | B2 * | 8/2010 | Eguchi et al. | 250/492.3 |
| 2011/0057115 | A1 | 3/2011 | Ferraguti et al. | |
| 2012/0134878 | A1 | 5/2012 | Silvestri | |

FOREIGN PATENT DOCUMENTS

| | | |
|---|---|---|
| JP | 2005-247427 | 9/2005 |
| JP | 2010-285197 | 12/2010 |
| JP | 2011-520713 | 7/2011 |
| JP | 2011-251708 | 12/2011 |
| WO | 2009/139013 | 11/2009 |
| WO | 2010/128532 | 11/2010 |

OTHER PUBLICATIONS

Search report from E.P.O., mail date is Apr. 26, 2013, 12199073.3.

* cited by examiner

*Primary Examiner* — Kiet T Nguyen
(74) *Attorney, Agent, or Firm* — Greenblum & Bernstein, P.L.C.

(57) ABSTRACT

An electron beam cap-sterilizer radiates an electron beam onto caps while the caps are continuously conveyed. The caps are conveyed in the restricting conveying section while the movements of the caps are restricted, so that the caps roll down freely and separately from each other in the free conveying section. The electron beam radiating device emits electron beams onto the inside of the caps in the lateral direction while the caps are conveyed in the free conveying section. A deflecting device is provided in the free conveying section. The deflecting device is located at the opposite side of the electron beam radiating device to deflect the electron beams emitted by the electron beam radiating device onto the outside of the caps.

11 Claims, 2 Drawing Sheets

ELECTRON BEAM STERILIZER FOR CAP

BACKGROUND OF THE INVENTION

1. Field of the Invention

The present invention relates to an electron beam sterilizer for caps, in which caps are irradiated by an electron beam and sterilized while they are conveyed.

2. Description of the Related Art

Conventionally, there is known an electron beam cap-sterilizer in which caps are irradiated by an electron beam and sterilized while the caps are continuously conveyed. In such an electron beam cap-sterilizer utilizing an electron beam, a cap chute, which is disposed inclined in a downward direction, is usually used as a conveying device for supplying the caps to an electron beam radiating device, as disclosed in Japanese Unexamined Patent Publication (Translation of PCT Application) No. 2011-520713. In the electron beam cap-sterilizer disclosed in this publication, caps are separated one by one using a star-wheel, and are sent out to the cap chute, in which each of the caps is rolled down and is irradiated by an electron beam.

On the other hand, in an electron beam cap-sterilizer disclosed in Japanese Unexamined Patent Publication No. 2010-285197, a cap makes contact with a surface of an inclined conveying passage while not in contact with another surface of the conveying passage, so that the cap is rotated due to the friction from contact. An electron beam radiating device is provided in a predetermined range contained in the conveying passage, to radiate an electron beam onto the rotating cap through a radiation window of the electron beam radiating device, by which the cap is sterilized. In the electron beam cap-sterilizer disclosed in this publication, a star-wheel is disposed at the lower end of the conveying passage in order to intermittently eject a cap from an outlet of the conveying passage.

In the electron beam cap-sterilizer disclosed in '713, the electron beam is emitted in a section in which caps moving through the cap chute are rotated. However, in the section in which the caps are freely rotated, the caps are accelerated due to the force of gravity. Therefore, a radiation distance through which the electron beam is emitted should be long enough to ensure a radiation time that is sufficient to sterilize the caps, and thus, the electron beam radiating device must be large in order to radiate a wide-ranging beam.

On the other hand, in the electron beam cap-sterilizer disclosed in '197, the star-wheel for ejecting caps is provided on the downstream side of the radiating section of an electron beam. In such a structure, caps come into contact with each other in the radiating section. Therefore, the caps rotate very little because of the friction, and thus, the surface of the cap is not uniformly irradiated by the electron beam.

SUMMARY OF THE INVENTION

Therefore, an object of the present invention is to provide an electron beam cap-sterilizer in which the radiation distance is shortened in comparison with a conventional device, and thus, the electron beam radiating device can be miniaturized so that ultimately the electron beam cap-sterilizer can be miniaturized as well.

According to the present invention there is provided an electron beam cap-sterilizer which radiates an electron beam onto caps while the caps are continuously conveyed, to sterilize the insides and the outsides of the caps, the electron beam cap-sterilizer comprising a chamber, a conveying passage, a conveying device, an electron beam radiating device, and a deflecting device.

Positive pressure is maintained inside of the chamber. The caps are conveyed to pass through the conveying passage of the chamber. The conveying passage has a restricting conveying section and a free conveying section connected to the restricting conveying section. The movement of the caps is restricted as they are conveyed in the restricting conveying section. The caps roll down freely and separately from each other in the free conveying section. The caps are conveyed through the conveying passage with the inside of each cap facing a lateral direction. The conveying device is provided in the restricting conveying section. The conveying device engages with the caps to convey the caps at a speed lower than the downhill rolling speed in the free conveying section. The electron beam radiating device is provided over the restricting conveying section and the free conveying section. The electron beam radiating device emits electron beams onto the inside of the caps in the lateral direction while the caps are conveyed through the conveying passage. The deflecting device is provided in the free conveying section. The deflecting device is located at the opposite side of the electron beam radiating device to deflect the electron beams emitted by the electron beam radiating device onto the outside of the caps.

BRIEF DESCRIPTION OF THE DRAWINGS

The object and advantages of the present invention will be better understood from the following description, with reference to the accompanying drawings in which.

DESCRIPTION OF THE PREFERRED EMBODIMENTS

Figure 1:
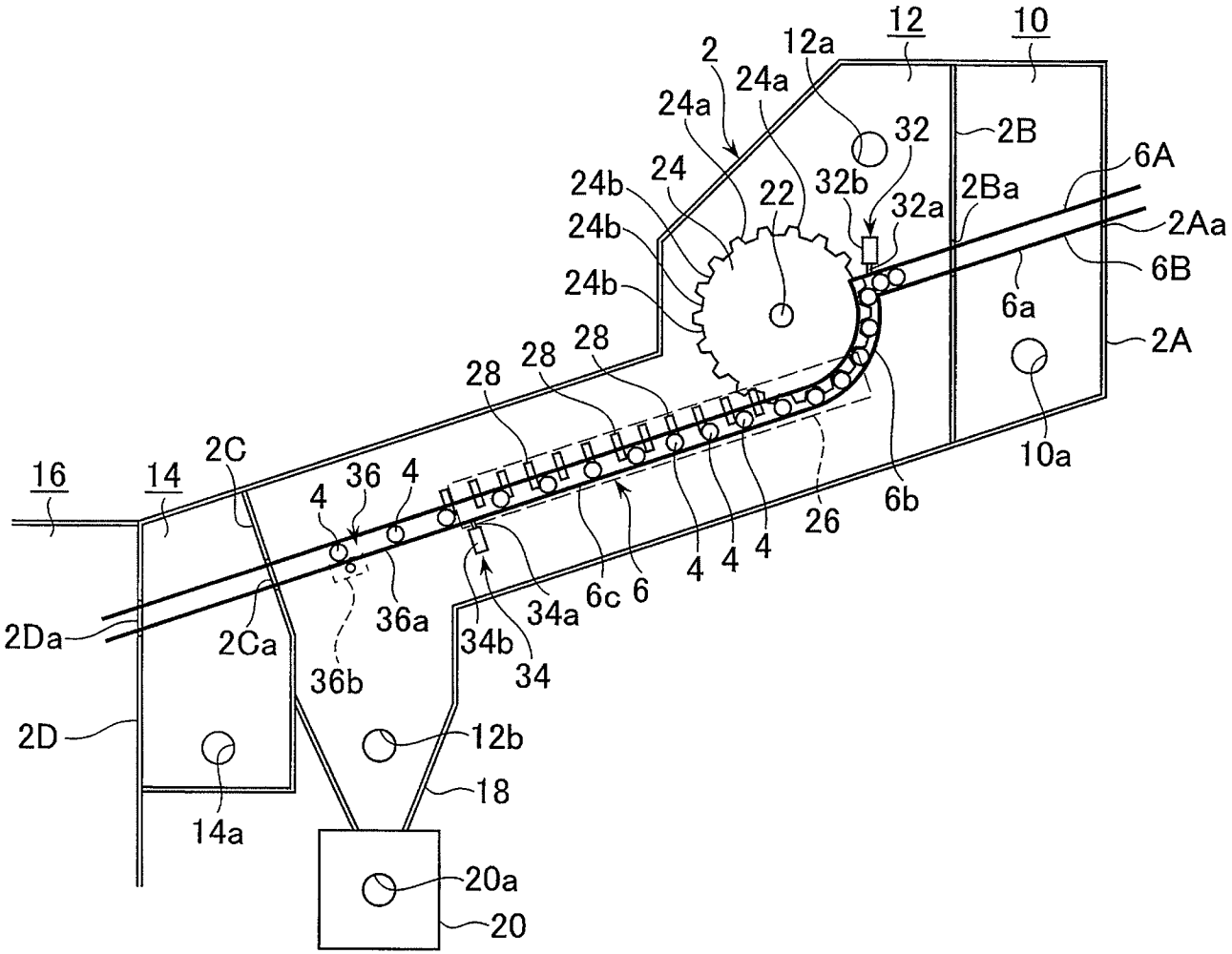
FIG. 1 is a longitudinal sectional view of an electron beam cap-sterilizer along a cap conveying passage, to which an embodiment of the present invention is applied.

An embodiment of the present invention will be described below with reference to the drawings.

An electron beam cap-sterilizer has an aseptic chamber 2, divided into a plurality of chambers, in which a conveying passage 6 is provided through which caps 4 are conveyed. The caps 4 conveyed through the conveying passage 6 are sterilized by electron beams emitted by an electron beam radiating device 8 (see FIG. 2), and then transferred to a capping apparatus (not shown).

The aseptic chamber 2 is divided into a front chamber 10, which is located in the furthest upstream section of the aseptic chamber 2 where caps 4 are supplied from the outside, a sterilizing chamber 12 in which a rotational conveying device and an electron beam radiating device 8 are disposed, and a rear chamber 14 provided immediately downstream of the sterilizing chamber 12. A capping chamber 16, in which a capping apparatus (not shown) is mounted, is connected to the downstream side of the rear chamber 14. The aseptic chamber is constructed of lead plates to block X-rays (Bremsstrahlung X-ray) or radiation generated by the electron beam.

The conveying passage 6 through which the caps 4 are conveyed in the chambers 10, 12, 14, and 16, in this order, has four guide rods 6A, 6B, 6C, and 6D, which are placed on the right, left, upper, and lower sides of the conveying passage 6. Note that, in FIG. 1, only the upper and lower guide rods 6A and 6B are shown, and the right and left guide rods 6C and 6D have been omitted. The conveying passage 6 is a so-called cap chute, which is inclined downward from the upstream to the downstream direction. The guide rods 6A and 6B provided on the upper and lower sides are separated from each other by a space slightly greater than the diameter of the caps 4. The guide rods 6C and 6D provided on the right and left sides are separated from each other by a space slightly greater than the height (a distance between a top surface 4*a* and a mouth 4*b*) of the caps 4. Thus, the conveyed caps 4 are stably held between the guide rods 6A, 6B, 6C, and 6D, and smoothly roll downward.

An opening 2Aa is formed in an inlet side wall 2A of the front chamber 10, and the conveying passage 6 defined by guide rods 6A, 6B, 6C, and 6D passes through the opening 2Aa. Similarly, openings 2Ba, 2Ca, and 2Da are formed in a separation wall 2B separating the front chamber 10 from the sterilizing chamber 12, a separation wall 2C separating the sterilizing chamber 12 from the rear chamber 14, and a separation wall 2D separating the rear chamber 14 from the capping chamber 16, so that the conveying passage 6 passes through all four chambers.

Air openings 12*a* and 12*b* are formed in the upstream portion and downstream portion of the aseptic chamber 12, to allow aseptic air to enter through a filter (not shown) from the outside, so that the aseptic chamber 12 is maintained at a positive pressure. An air discharge opening 10*a* is formed in a wall of the front chamber 10 located on the upstream side of the sterilizing chamber 12, so that the front chamber 10 is maintained at a positive pressure lower than the pressure in the sterilizing chamber 12 due to the air flowing from the sterilizing chamber 12 into the front chamber 10. A collection box 20 is connected to the downstream side of the sterilizing chamber 12 through an ejecting passage 18, which is formed to face downward. An air discharge opening 20*a* is formed in a wall of the collection box 20, so that the collection box 20 is maintained at a positive pressure lower than the pressure in the sterilizing chamber 12.

An air inlet opening 14*a* is formed in a wall of the rear chamber 14 located on the downstream side of the sterilizing chamber 12, so that the rear chamber 14 is maintained at a positive pressure higher than the pressure in the sterilizing chamber 12 due to the aseptic air flowing from the outside. The capping chamber 16 connected downstream of the rear chamber 14 is supplied with aseptic air through an air inlet opening (not shown), so that the capping chamber 16 is maintained at a positive pressure higher than the pressure in the rear chamber 14.

Therefore, regarding the chambers 10, 12, 14, and 16, which are connected in series, the pressures are controlled in such a manner that the furthest downstream capping chamber 16 has the highest pressure, and the rear chamber 14, the sterilizing chamber 12, and the front chamber 10 become lower in this order. The collection box 20 is maintained at a positive pressure lower than the pressure in the sterilizing chamber 12. The front chamber 10, in which the pressure is the lowest among the chambers 10, 12, 14, and 16, is maintained at a positive pressure higher than the ambient outside air pressure, and thus the outside air does not enter the chambers.

The conveying passage (i.e., cap chute) 6 has a restricting conveying section and a free conveying section connected to the restricting conveying section. In the free conveying section the caps 4 are held among the guide rods 6A, 6B, 6C, and 6D in a state in which the top surface 4*a* and the mouth 4*b* face a lateral or horizontal direction, which allows them to roll down freely under the force of gravity. In the restricting conveying section, the caps 4 are conveyed while their movement is restricted by a star-wheel, which is a rotational conveying device that is described below.

An upstream portion of the sterilizing chamber 12 is provided with a star-wheel (i.e., a rotational conveying device) 24, which is rotated about a horizontal axis 22 in a vertical plane. Contact portions 24*a*, which are in contact with the caps 4, are projected at equal intervals on an outer periphery of the star-wheel 24, so that a plurality of pockets (cap-receiving portion) 24*b* are formed on the outer periphery. Due to the operations of the contact portions 24*a*, the continuously conveyed caps 4, which are free to make contact with the front and rear portions each other in the free conveying section 6*a* upstream of the star-wheel 24, are separated by a constant distance and deposited downstream of the star-wheel 24 while the cylindrical portion 4*c* of each of the caps 4 is in contact with the front surface of the contact portions 24*a*, thus restricting the free movement of the caps 4.

Therefore, the conveying passage 6 has an arc-shaped portion 6*b*, which is connected to the downward-inclined free conveying section 6*a* and arranged on the outer peripheral side of the star-wheel 24 with an approximately the same outer diameter as the star-wheel 24. The restricting conveying section is formed by the arc-shaped portion 6*b*, in which the caps 4 are conveyed with their movement restricted by the star-wheel 24.

A downstream free conveying section 6*c* having approximately the same inclination as the upstream free conveying section 6*a* is provided and connected to the restricting conveying section 6*b*. The downstream free conveying section 6*c* extends through the sterilizing chamber 12, the rear chamber 14, and the capping chamber 16. In the restricting conveying section 6*b*, the caps 4 are conveyed at a lower conveying speed than in the downstream conveying section 6*c* due to the restriction imposed by the star-wheel 24.

An electron beam radiating device 8, which emits an electron beam onto the caps 4 being conveyed, is provided over a range from the lower portion of the star-wheel 24 to the downstream side of the conveying passage 6. The electron beam radiating device 8 is not shown in FIG. 1, but a range indicated by a broken line is the radiation area of the electron beam radiating device 8. The radiating area covers the downstream free conveying section 6*c* and part of the restricting conveying section 6*b*, which is located upstream of the downstream free conveying section 6*c*. Operation of the electron beam radiating device 8 is controlled by a control unit (not shown), which monitors the radiating condition of the electron beam and has the capability to detect any abnormal conditions.

Figure 2:
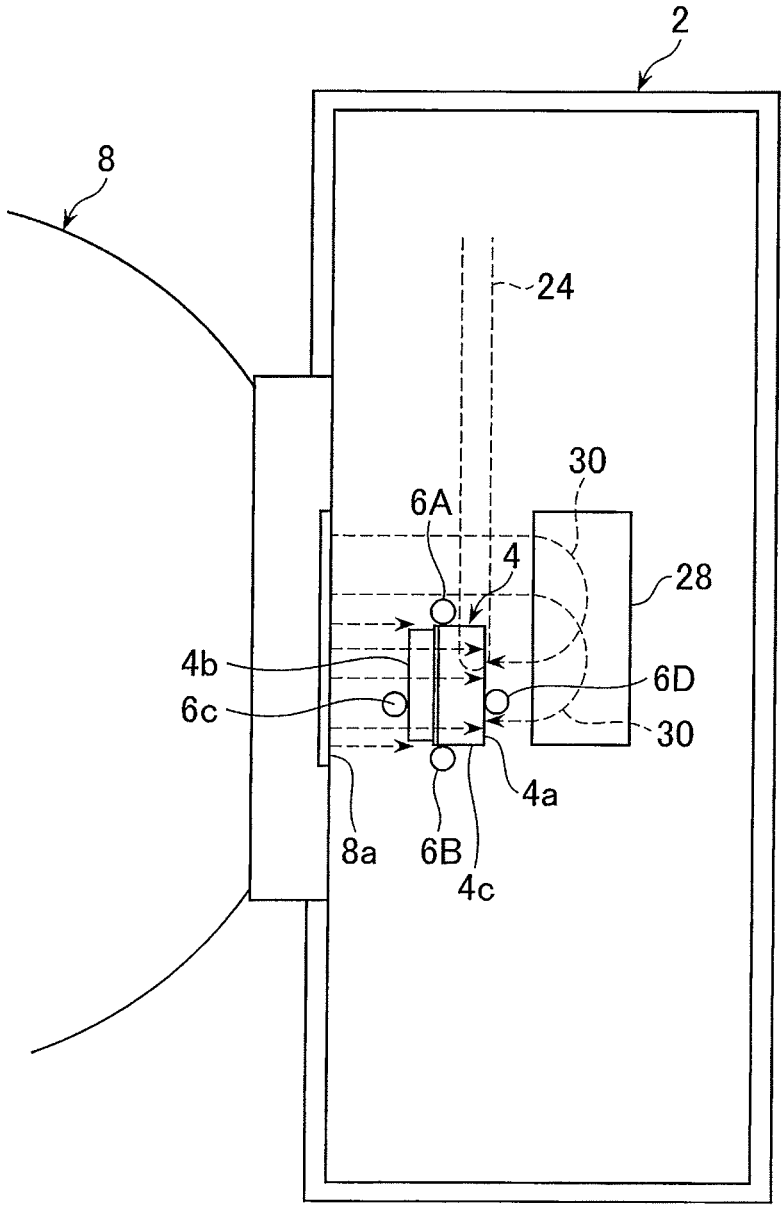
FIG. 2 is a sectional view of the electron beam cap-sterilizer within an electron beam radiating area, along a line perpendicular to the conveying passage.

The caps 4 are conveyed in the conveying passage 6 in a state in which the top surface 4*a* and the mouth 4*b* face a horizontal direction. Namely, as shown in FIG. 2, a radiation window 8*a* of the electron beam radiating device 8 faces the mouth 4*b* of the cap 4. A plurality of magnets 28 are located on the opposite side of the electron beam radiating device 8 with respect to the conveying passage 6, and spaced apart from each other along the longitudinal direction of the downstream free conveying section 6*c*. These magnets 28 deflect the electron beams, which are emitted toward the mouth 4*b* of the caps 4 by the electron beam radiating device 8, back onto the top surface 4*a* of the caps 4 (see the broken line 30 in FIG. 2).

For reflecting the electron beam passing through the outside of the cylindrical portion 4*c* of the cap 4 back onto the top surface 4*a* of the cap 4, the magnet 28 is disposed so that it extends from the lateral side of the conveying passage 6 or the cap 4 to the upper side as shown in FIG. 2 or to the lower side.

A magnet generating a strong magnetic force, such as a Neodymium magnet, Samarium-cobalt magnet, and so on, is utilized for the magnet 28. If the magnet 28 is extended from the lateral side of the cap 4 to the upper side, the magnet 28 is arranged such that the N-pole is oriented upstream and the S-pole is oriented downstream of the conveying direction, so that a magnetic field directing from the upstream side to the downstream side is generated between the magnets 28. Due to this, the electron beams are electromagnetically deflected from the upper side to the lower side to form a circle, thereby irradiating onto the top surface 4*a* of the cap 4. Conversely, if the magnet 28 is extended from the lateral side of the cap 4 to the lower side, the magnet 28 is arranged such that the S-pole is oriented upstream and the N-pole is oriented downstream of the conveying direction, so that a magnetic field is generated between the magnets 28 from the downstream side to the upstream side. Due to this, the electron beams are electromagnetically deflected from the lower side to the upper side to form a circle, thereby irradiating onto the top surface 4*a* of the cap 4.

An upstream stopping device 32 is positioned at the downstream end of the upstream free conveying section 6*a*, to which the upstream side of the restricting conveying section 6*b* is connected. A downstream stopping device 34 is positioned close to the downstream end of the electron beam radiation area 26, which is the downstream side of the free conveying section 6*c*. The stopping devices 32 and 34 have stoppers 32*a* and 34*a*, which can be projected into and retracted from the conveying passage 6, and air cylinders 32*b* and 34*b*, which drive the stoppers 32*a* and 34*a*.

An ejecting device 36 is provided on the downstream side of the downstream stopping device 34 to eject the caps 4 from the conveying passage 6. The ejecting device 36 is constructed such that an air cylinder 36*b* moves a part 36*a* of the lower guide rod 6B, which can be separated from the other part of the lower guide rod 6B. Namely, the ejecting guide rod portion 36*a* can be switched between a connecting position, at which the portion 36*a* is connected to the upstream side and the downstream side of the lower guide rod 6B, and a retracted position, at which the portion 36*a* is disengaged from the lower guide rod 6B to drop the cap 4 from the conveying passage 6. In this embodiment, the ejecting guide rod portion 36*a* can be moved laterally with respect to the direction of movement of the cap 4 by the air cylinder 36*b*, and thus the cap 4 is dropped.

The collection box 20 is attached to a lower portion of the ejecting device 36 through the ejecting passage 18, at the downstream end of the sterilizing chamber 12. Thus, when the ejecting guide rod portion 36*a* of the ejecting device 36 is moved to disengage from the lower guide rod 6B, the cap 4 drops into the collection box 20 and is expelled from the electron beam cap-sterilizer.

The operations of the electron beam cap-sterilizer will be described below. The caps 4 transported from the outside to the front chamber 10 of the electron beam cap-sterilizer, are supplied to the conveying passage 6 in such a manner that their top surfaces 4*a* and mouths 4*b* are oriented in the lateral direction. Thus, the cylindrical surface 4*c* is positioned on the lower guide rod 6B and each of the caps 4 roll down in the upstream free conveying section 6*a* in contact with the immediately preceding and trailing caps while their upper surfaces are guided by the upper guide rod 6A, and their right and left surfaces are guided by the right and left guide rods 6C and 6D.

The caps 4 rolling down in the upstream free conveying section 6*a* pass through the position at which the upstream stopping device 32 is set to a condition in which the stopper 32*a* is retracted from the conveying passage 6, and are captured in the pockets 24*b* of the star-wheel 24 one by one. Thus, the caps 4 are conveyed in the arc-shaped restricting conveying section 6*b* of the conveying passage 6 in accordance with the rotation of the star-wheel 24. At this time, an outer surface of the cylindrical portion 4*c* of the cap 4 is in contact with the lower guide rod 6B, and the caps 4 are conveyed through rotation in the pockets 24*b*.

Thus, the caps 4 are restricted as they are conveyed in the restricting conveying section 6*b* by a quarter-circle turn of the star-wheel 24 before entering the downstream free conveying section 6*c* of the conveying passage 6, in which the caps 4 are released from the pockets 24*b* of the star-wheel 24. The caps 4 roll freely down on the lower guide rod 6B in the downstream free conveying section 6*c* while guided by the upper, right, and left guide rods 6A, 6C, and 6D. The caps 4 conveyed in the upstream free conveying section 6*a* while in contact with the immediately preceding and trailing caps are separated from each other by the distance between the adjacent pockets 24*b* of the star-wheel 24 and delivered to the downstream free conveying section 6*c* where they leave behind a constant space to be conveyed in the downstream free conveying section 6*c*. In the restricting conveying section 6*b*, the rotation speed of the star-wheel 24 is controlled such that the caps 4 are conveyed at a speed lower than the downhill rolling speed in the downstream free conveying section 6*c*.

The electron beam radiating device 8 is provided over the restricting conveying section and the free conveying section, and more particularly, provided from the lower portion of the star-wheel 24 (or the latter half portion of the arc-shaped restricting conveying section 6*b*) to a mid portion of the downstream free conveying section 6*c*, which is the electron beam radiation area 26. The electron beam radiating device 8 is disposed on a lateral side of the conveying passage 6, so that the caps 4 are exposed to electron beams in the electron beam radiation area 26.

In the electron beam radiation area 26, the caps 4 are conveyed at a constant speed by the star-wheel 24 in the restricting conveying section 6*b*, and electron beams irradiated the insides of the caps 4 for a period of time required to sterilize the insides of the caps. In the downstream free conveying section 6*c*, since the caps 4 are conveyed while being separated from each other by more than a predetermined distance, and accordingly are not in contact with one another, the insides of the caps 4 are directly irradiated by electron beams emitted thereto, the cylindrical portions 4*c* are irradiated by electron beams passing by, and the top surfaces 4*c* are irradiated by electron beams deflected by the magnet 28. Thus, all of the outer surfaces of the caps 4 are uniformly irradiated by the electron beams and thereby sterilized. That is, the entire surface of the caps 4 is sterilized by the electron beams radiated in a single direction or a lateral direction. Further, since the caps 4 are conveyed while rolling downhill on the lower guide rod 6B in the restricting conveying section 6*b* and the downstream free conveying section 6*c*, portions of the caps 4 where the electron beams are obstructed by the guide rods 6A, 6B, 6C, and 6D are shifted by rotation, and thus the complete inside and outside surfaces of the cap 4 can be irradiated by the electron beams.

When electron beams emitted by the electron beam radiating device 8 are normal, the caps 4 roll downhill and are conveyed through the conveying passage 6, where they are sterilized. The sterilized caps 4 then pass through the rear chamber 14 and are conveyed to the capping chamber 16, in which a capping operation is performed by the capping apparatus (not shown).

As described above, while electron beams are normally radiated from the electron beam radiating device 8 onto the caps 4 conveyed in the conveying passage 6, the upstream stopping device 32, the downstream stopping device 34, and the ejecting device 36 are not operated, so that the caps 4 are continuously conveyed and irradiated by electron beams. However, if an abnormal condition occurs, for example an electric discharge or a drop in vacuum pressure in the electron beam radiating device 8 causes an inadequate electron beam, the control device detects this abnormal condition and commands the downstream stopping device 34 to stop conveying the caps 4, and halt the star-wheel 24. When an abnormal radiation level is detected in the electron beam, the caps 4 currently in the electron beam radiation area 26 are stopped by the star-wheel 24 and the stopper 34*a*, which is projected into the conveying passage 6 by the air cylinder 34*b* of the downstream stopping device 34. Then, the upstream stopping device 32 is also operated, so that the caps 4 in the upstream free conveying section 6*a* do not enter the arc-shaped restricting conveying section 6*b*.

When the problem affecting the electron beam radiating device 8 is resolved and electron beams can be emitted, the electron beams are emitted while the upstream stopping device 32, the downstream stopping device 34, and the star-wheel 24 are maintained in the stop position. The caps 4, which may not be completely sterilized because of the abnormal radiation level detected in the electron beam, are stopped and held in the electron beam radiation area 26 by the downstream stopping device 34 and the star-wheel 24, and thus, the caps 4 are subjected to a normal electron beam radiation, and sterilized.

After the caps 4 held in the electron beam radiation area 26 are sterilized by electron beams radiated thereto, the downstream stopping device 34 is released or opened and the operation of the star-wheel 24 is resumed, so that the caps 4 are conveyed again. Further, the ejecting device 36 is operated, and the air cylinder 36*b* is actuated so that the ejecting guide rod portion 36*a* can be moved to expel the caps 4. Due to the release or opening of the downstream stopping device 34, the caps 4 held in the electron beam radiation area 26 roll down the downstream free conveying section 6*c*. The caps 4 are then expelled from the position where the ejecting guide rod portion 36*a* is retracted and are cast into the collection box 20 through the ejecting passage 18.

Thus, caps 4 that are not completely sterilized because of the abnormal electron beam radiation are prevented from contaminating the guide rods 6A, 6B, 6C, 6D, and the sterilizing chamber 12, since the electron beam radiating device 8, upon returning to its normal state of operation, radiates electron beams onto the caps 4 to completely sterilize the caps 4, and ejects the caps 4 to the collection box 20. Further, the inside of the sterilizing chamber 12 is not contaminated and the recovery time from the occurrence of the abnormal condition can be shortened.

Furthermore, the electron beam cap-sterilizer of this embodiment is provided with a section in the electron beam radiation area 26 where the caps 4 are conveyed while restricted by the star-wheel 24, and thus the caps 4 travel at a constant speed lower than in the downstream free conveying section 6*c*. Thus, the lower speed allows for the radiation distance of the electron beams to be reduced and provides the electron beam cap-sterilizer with enough time to fully sterilize the insides of the caps 4, which is of particular importance because they will be in contact with the contents of the bottles. As a result, the electron beam radiating device 8 can be miniaturized, and accordingly the electron beam cap-sterilizer is also miniaturized. On the other hand, the sterilizing time can be easily adjusted by changing the rotation speed of the star-wheel 24.

In the downstream free conveying section 6*c*, the caps are conveyed with space separating them from the immediately preceding and trailing caps, and thus, the caps 4 are not in contact with each other, so that the outer surface of the cylindrical portion 4*c* of each of the caps 4 is uniformly irradiated by electron beams, and is fully sterilized. Further, by deflecting electron beams onto the caps 4 by the magnet (i.e., a deflecting device) 28, the entire surface including the inside and outside surfaces of each of the caps 4 is irradiated by the electron beams and sterilized by the single electron beam radiating device 8.

Although the embodiments of the present invention have been described herein with reference to the accompanying drawings, obviously many modifications and changes may be made by those skilled in this art without departing from the scope of the invention.

The present disclosure relates to subject matter contained in Japanese Patent Application No. 2011-285754 (filed on Dec. 27, 2011) which is expressly incorporated herein, by reference, in its entirety.

The invention claimed is:

1. An electron beam cap-sterilizer which radiates an electron beam onto caps while the caps are continuously conveyed, to sterilize the insides and the outsides of the caps, said electron beam cap-sterilizer comprising:

a chamber inside of which positive pressure is maintained;

a conveying passage through which the caps are conveyed to pass through said chamber, said conveying passage having a restricting conveying section and a free conveying section connected to said restricting conveying section, the caps being conveyed in said restricting conveying section while the movement of the caps is restricted, the caps rolling down freely and separately from each other in said free conveying section, the caps being conveyed through said conveying passage with the inside of each cap facing a lateral direction;

a conveying device provided in said restricting conveying section, said conveying device engaging with the caps to convey the caps at a speed lower than the downhill rolling speed in said free conveying section;

an electron beam radiating device provided over said restricting conveying section and said free conveying section, said electron beam radiating device emitting electron beams onto the inside of the caps in the lateral direction while the caps are conveyed through said conveying passage; and a deflecting device provided in said free conveying section, said deflecting device being located at the opposite side of said electron beam radiating device to deflect the electron beams emitted by said electron beam radiating device onto the outside of the caps.

2. The electron beam cap-sterilizer according to claim 1, wherein said restricting conveying section comprises an arc-shaped guide rod and said free conveying section comprises a straight guide rod, said restricting conveying section being provided with a rotational conveying device having engaging portions on the outer periphery thereof to engage with the caps.

3. The electron beam cap-sterilizer according to claim 1, wherein said deflecting device comprises a plurality of magnets disposed along said conveying passage that are separated from each other.

4. The electron beam cap-sterilizer according to claim 3, wherein each of said magnets extends from the lateral side of the conveying passage to the upper side of the conveying passage such that the N-pole is oriented upstream and the S-pole is oriented downstream of the conveying direction.

5. The electron beam cap-sterilizer according to claim 3, wherein each of said magnets extends from the lateral side of the conveying passage to the lower side of the conveying passage such that the S-pole is oriented upstream and the N-pole is oriented downstream of the conveying direction.

6. The electron beam cap-sterilizer according to claim 1, wherein said chamber is divided into a sterilizing chamber into which an electron beam is radiated, a front chamber provided upstream of said sterilizing chamber, and a rear chamber provided downstream of said sterilizing chamber.

7. The electron beam cap-sterilizer according to claim 6, wherein said front chamber is maintained at a positive pressure lower than the pressure in said sterilizing chamber.

8. The electron beam cap-sterilizer according to claim 6, wherein said rear chamber is maintained at a positive pressure higher than the pressure in said sterilizing chamber.

9. The electron beam cap-sterilizer according to claim 6, further comprising a capping chamber connected downstream of said rear chamber, a capping apparatus being housed in said capping chamber.

10. The electron beam cap-sterilizer according to claim 9, wherein said capping chamber is maintained at a positive pressure higher than the pressure in said rear chamber.

11. The electron beam cap-sterilizer according to claim 1, wherein said conveying passage comprises guide rods provided on the right, left, upper, and lower sides of said conveying passage.

* * * * *